US007691042B2

(12) United States Patent
Pandozy

(10) Patent No.: US 7,691,042 B2
(45) Date of Patent: Apr. 6, 2010

(54) ABDOMINAL EXERCISING APPARATUS AND METHOD

(76) Inventor: Raffaele Martini Pandozy, 2312 Grand Ave., Apt. A, Dallas, TX (US) 75215

( * ) Notice: Subject to any disclaimer, the term of this patent is extended or adjusted under 35 U.S.C. 154(b) by 365 days.

(21) Appl. No.: 12/386,488

(22) Filed: Aug. 24, 2007

(65) Prior Publication Data

US 2009/0305856 A1 Dec. 10, 2009

Related U.S. Application Data

(63) Continuation-in-part of application No. 10/998,875, filed on Nov. 29, 2004, now abandoned.

(51) Int. Cl.
*A63B 26/00* (2006.01)

(52) U.S. Cl. ..... 482/142

(58) Field of Classification Search ..... 482/142, 482/148, 91, 907, 140; D21/676, 686, 690, D21/662

See application file for complete search history.

(56) References Cited

U.S. PATENT DOCUMENTS 1,904,039 A * 4/1933 Bruder ..... 606/240
2,159,654 A * 5/1939 Catlin ..... 606/240
2,264,046 A * 11/1941 McClellan ..... 482/145
3,102,280 A * 9/1963 Williams ..... 441/130
D237,813 S * 11/1975 England ..... D21/688
4,190,286 A * 2/1980 Bentley ..... 297/284.3
4,210,322 A * 7/1980 Pritchard ..... 482/23
D267,028 S * 11/1982 Spisak ..... D21/686
4,372,553 A * 2/1983 Hatfield ..... 482/105
4,474,370 A * 10/1984 Oman ..... 482/104
D284,394 S * 6/1986 Bengtson et al. ..... D21/676
4,796,315 A * 1/1989 Crew ..... 5/630
4,867,142 A * 9/1989 Jones ..... 601/115
4,953,857 A * 9/1990 Lemire ..... 482/142
5,007,633 A * 4/1991 Lemire ..... 482/142
5,110,122 A * 5/1992 Moore et al. ..... 482/134
5,304,109 A * 4/1994 Shockley ..... 482/142
5,447,481 A * 9/1995 Emter, Jr. ..... 482/104
5,549,534 A * 8/1996 Parviainen ..... 482/137
5,584,786 A * 12/1996 Almeda ..... 482/142
5,722,923 A * 3/1998 Lui ..... 482/140
5,755,647 A * 5/1998 Watnik ..... 482/121
5,795,276 A * 8/1998 Almeda ..... 482/142
5,931,769 A * 8/1999 Nunez ..... 482/142
5,947,876 A * 9/1999 Willey, II ..... 482/140
6,015,370 A * 1/2000 Pandozy ..... 482/97

(Continued)

*Primary Examiner*—Lori Baker
(74) *Attorney, Agent, or Firm*—Schultz & Associates, P.C.

(57) ABSTRACT

The disclosed invention provides an abdominal exerciser comprised of a padded bench with an adjustable arc shaped lumbar support mounted to a tubular support frame. The radius of the lumbar support is slightly larger than the radius of ordinary spinal arching. The lumbar support fully extends the lumbar section of the spine decompressing the intervertebral space while stretching the abdominal muscles and neutralizing the lumbar muscles in preparation for a sit-up or legs-up movement in which the spine is fully supported. Adjustably attached on either side of the lumbar support are two generally semicircular shaped side extensions. The support frame includes a base, two feet, and an arc shaped extension with a plurality of parallel footrests. The support frame also includes a hinge about which the bench rotates through the arc of the extension to adjust the inclination angle of the bench.

13 Claims, 6 Drawing Sheets

U.S. PATENT DOCUMENTS 6,390,960 B1 * 5/2002 Boland ..... 482/140
6,422,980 B1 * 7/2002 Simonson ..... 482/99
6,467,841 B1 * 10/2002 Henschel et al. ..... 297/284.5
RE38,057 E * 4/2003 Pandozy ..... 482/97
6,755,771 B2 * 6/2004 Wallerstein ..... 482/140
6,843,759 B2 * 1/2005 Wallerstein ..... 482/92
6,899,662 B2 * 5/2005 Gamble et al. ..... 482/142
6,994,661 B1 * 2/2006 Dawson ..... 482/146
7,060,085 B2 * 6/2006 Graham et al. ..... 606/240
7,258,653 B2 * 8/2007 Brandon et al. ..... 482/142
D555,741 S * 11/2007 Wachtfogel et al. ..... D21/686
D560,259 S * 1/2008 Heggdal ..... D21/690
7,329,213 B1 * 2/2008 Farley ..... 482/140
7,341,565 B2 * 3/2008 Splane et al. ..... 601/5
7,357,759 B2 * 4/2008 Bonnell ..... 482/72
7,384,383 B2 * 6/2008 Forcillo et al. ..... 482/140
D578,219 S * 10/2008 Daggett ..... D24/183
7,452,313 B2 * 11/2008 Endelman ..... 482/140
7,601,109 B2 * 10/2009 Roumayah ..... 482/142
7,604,580 B2 * 10/2009 Lamarque ..... 482/140
2004/0077468 A1 * 4/2004 Myles et al. ..... 482/140
2004/0259703 A1 * 12/2004 Goh ..... 482/140
2006/0040811 A1 * 2/2006 Foster ..... 482/142
2006/0116262 A1 * 6/2006 Pandozy ..... 482/142
2008/0119338 A1 * 5/2008 Prsala ..... 482/142
2009/0018000 A1 * 1/2009 Brown et al. ..... 482/140
2009/0177121 A1 * 7/2009 Brandon et al. ..... 600/587
2009/0227435 A1 * 9/2009 Pandozy ..... 482/142

* cited by examiner

ABDOMINAL EXERCISING APPARATUS AND METHOD

CROSS-REFERENCE TO RELATED APPLICATIONS

This application is a Continuation-In-Part claiming priority benefit from U.S. patent application Ser. No. 10/998,875 entitled "Biodynamic Apparatus for Performing Correct Sit-up and Legs-up Exercises and Methods" filed on Nov. 29, 2004 now abandoned.

FIELD OF THE INVENTION

The present invention relates to an abdominal exercise apparatus. In particular, the invention relates to a bench with an adjustable support that fully extends the lumbar section of the vertebral column and safeguards the normal curvature of the spine during a sit-up or legs-up movement.

BACKGROUND OF THE INVENTION

Exercises aimed at strengthening the abdominal muscles include the traditional sit-up and legs-up movements. This type of movement, typically performed lying supine on a flat surface of the floor causes negative stress to the spine and can lead to back muscle and spinal injuries. Because of the flat surface, the starting position tilts the pelvis and tends to straighten the natural curvature of the lumbar section of the spine. When performing a sit-up or legs-up movement in this position, injuries such as back muscle strain, particularly the lumbar muscles, or abnormal compression of intervertebral discs leading to slipped or herniated discs and pinched nerves may occur.

The ordinary sit-up movement is initiated in the neck area, specifically by the contraction of the neck muscles, followed by the pectoral muscles and finally the abdominal muscles. This progression of muscle groups produces negative stress along the length of the spine tending to straighten it first in the cervical section, then in the thoracic section, and finally in the lumbar section. Because the lumbar section of the spine is unsupported by the flat floor, the ordinary legs-up movement produces the same compressive pressures on the vertebral column as the sit-up movement.

FIG. 9 illustrates the negative stresses on the spine and the tendency to straighten the spine during an ordinary sit-up movement performed on a flat surface. The first 15° of the movement are initiated by the neck muscles attending to the 100% pull of the head. During this fraction of time, the spine bears 85% of the stress produced by the weight of the head because the abdominal muscles do not begin to contract until after the second half of the movement, or until the torso has moved past 45°. From zero to 45° the spine is under tremendous stress which tends to straighten the natural curvature of the spine and it is most apparent when observing exercisers in action. The head, at that initial moment is much heavier due to gravitational acceleration. Additionally, the drastic and sudden initial effort of lifting the head can compare to a car whiplash, with all the complications that this condition may comport to the cervical vertebral region.

The ideal abdominal exercise will reverse the order of muscle group engagement and prevent the negative stresses on the spine by maintaining the spine's natural curvature. Additionally, it is advantageous to simultaneously decompress or fully extend the lumbar section of the spine while stretching the abdominal muscles immediately before each sit-up movement. Full extension of the spine is not achieved when the back is flat on the floor, but rather when the spine is arched back or extended, a position the flat floor does not allow. Decompressing the spine helps to restore proper intervertebral space and allows the discs between the vertebrae to reacquire their proper thickness and function as the spine's shock absorbers. This exercising of the spine enhances the elasticity of cartilage and ligaments for a more flexible spine as well as enhances vertebral alignment and proper curvature of the spine. Further, the ideal abdominal exercise in addition to neutralizing the lumbar muscles should provide a starting position where the pelvis is not abnormally tilted and the torso or legs are free to pivot at the hip joint.

Numerous abdominal exercisers are known in the art. However, the prior art does not provide an abdominal exerciser that prevents negative stresses on the spine throughout a sit-up movement while additionally decompressing the lumbar section of the spine.

U.S. Pat. No. 4,372,553 to Hatfield discloses an exercising device having a seat in which the user sits and bends forward working against weights supported on a pulley system. The weights are connected to the user via a shoulder harness. The user's lumbar section is never fully extended throughout the movement and negative pressures are placed on the spine as the movement forces a progression of muscle groups instead of a simultaneous contraction.

U.S. Pat. No. 5,110,122 to Moore, et al. discloses an exercising apparatus that enables a large number of movements to be performed thereon especially abdominal and lower back exercises. The apparatus is generally a sectioned bench that comprises a seat supporting section, a back supporting section, and a head supporting section all initially in the same plane. Although the back supporting section may be inclined, it does not include an arched support to fully extend the vertebral column and performing a sit-up movement on the apparatus is identical to performing the movement on the flat floor.

U.S. Pat. No. 4,474,370 to Oman discloses a weight lifter's bench that includes a longitudinally adjustable pad providing lumbar support. The apparatus enables the user to perform the bench press exercise while supporting the cervical and lumber sections of the spine. While the apparatus is designed to support the lumbar region of the spine while developing body musculature, primarily the pectoral muscles of the chest, it does not exercise the abdominal muscles.

U.S. Pat. No. 4,953,857 to Lemire discloses an orthopedic back support attachment for a weight lifter's bench. The apparatus includes a padded cervical rest and a padded lumbar rest in combination with a padded mat each having a centrally aligned spine protecting channel that supports the back and eliminates the compression of the spinal column normally associated with weight lifting. The padded mat removably attaches to the top surface of a typical weight lifter's bench and the other two particularly shaped pads are removably attached to the pad side surface of the mat by the use of straps. Both the cervical rest and the lumbar rest are longitudinally adjustable to accommodate different size users. After attaching the padded mat to a bench, the bench loses its incline functionality. Additionally, the weight lifter's bench is not conducive to sit-up or legs-up movements.

U.S. Pat. No. 6,467,841 to Henschel, et al. discloses a longitudinally and height adjustable lumbar support attachment for a weight lifter's bench. The lumbar support is comprised of a plurality of interlocking stackable platelets. The platelets are relatively thin rectangular shaped members and the number of platelets used determines the height of the support. The removable lumbar support can also be used on the floor. In addition to the faults of the previously discussed weight lifter's benches, the rectangular shape of the support does not fully extend the lumbar section and thus does not decompress the spine.

SUMMARY OF INVENTION

The present invention addresses the need for an abdominal exercising apparatus that fully supports the spine and prevents negative stresses on the spine and back muscles throughout a sit-up or legs-up movement. Additionally, the present invention simultaneously decompresses the lumbar section of the vertebral column to help rejuvenate the intervertebral discs.

The components of the abdominal exerciser include a rectangular shaped padded bench affixed atop a tubular support frame. The support frame includes a base, two feet, and an arc shaped extension with a plurality of parallel footrests. The support frame also includes a hinge about which the bench rotates through the arc of the extension to adjust the inclination angle of the bench. The arc shaped extension includes a spring pin that secures the bench at the desired inclination degree. A longitudinally adjustable lumbar support, called a spinal flexor, rests on the top surface of the bench and is slidably attached to the tubular support frame. The supporting surface of the spinal flexor is an arc shape having a radius slightly larger than ordinary spinal arching. The spinal flexor is made of a semi-rigid material molded into the arc shape and surrounded by a padding layer and a durable cover layer. Adjustably attached on either side of the spinal flexor are two generally semicircular shaped side extensions.

Those skilled in the art will appreciate the above-mentioned features and advantages of the invention together with other important aspects thereof upon reading the detailed description that follows in conjunction with the drawings provided.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENT

Figure 1:
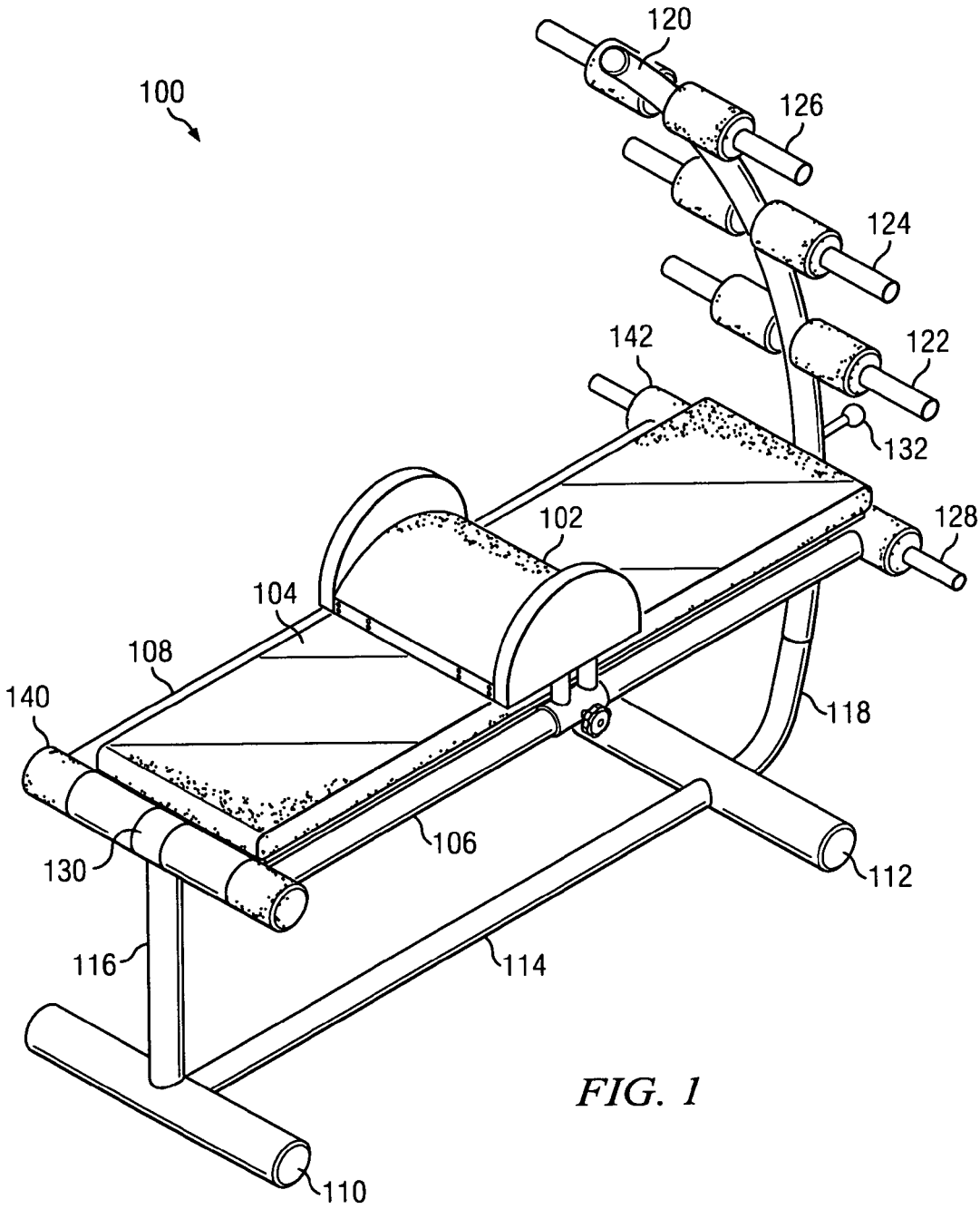
FIG. 1 is an isometric view of a preferred embodiment of the present invention.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Referring to FIG. 1, abdominal exercise apparatus 100 is comprised of a frame, a bench, a lumbar support, and a plurality of foot rests. The frame of abdominal exercise apparatus 100 is constructed of hollow tubular steel or aluminum approximately ⅛ inch thick and approximately two inches in diameter. Frame base 114 extends between foot 110 and foot 112 and connects to each at generally perpendicular angles forming the foundation of abdominal exercise apparatus 100. One end of frame brace 116 connects to foot 110 and extends perpendicularly from the floor. The opposite end of frame brace 116 forms hinge 130. Frame end 140 rotates inside of hinge 130 and connects to frame rail 106 and frame rail 108. The opposite ends of frame rails 106 and 108 connect to frame end 142. Foot rest 128 extends from both ends of frame end 142. Incline support 118 connects to foot 112 and extends from foot 112 in an arc shape. Incline support 118 slides inside incline housing 120. Incline housing 120 arcs with the same radius as incline support 118 to ensure unhindered travel of incline support 118. The radius of the arcs forming the shape of incline support 118 and incline housing 120 is approximately the length of frame rails 106 and 108. Incline housing 120 further includes incline pin 132 and foot rests 122, 124, and 126. In a preferred embodiment, incline pin 132 is approximately ½ inch in diameter and is removably secured to incline housing 120 through a hole and collar (not shown). Incline pin 132 fits through incline housing 120 and into one of a plurality of equally spaced holes bored into incline support 118 at different heights. Foot rests 122, 124, 126, and 128 are covered foam padding in the preferred embodiment. Foot rest 122 is located approximately at the midpoint of incline housing 120. Foot rest 126 is located near the end of incline housing 120 and foot rest 124 is located in between and equidistant from foot rest 122 and 126. In a preferred embodiment, the distance between foot rests may range between eight and twelve inches. Bench 104 is a generally rectangular shaped and padded as is known in the art. Bench 104 is supported by and attached to two additional frame rails (not shown) which connect to frame ends 140 and 142. Spinal flexor 102 rests on the top surface of bench 104 and is slidably attached to frame rails 106 and 108.

Figure 2:
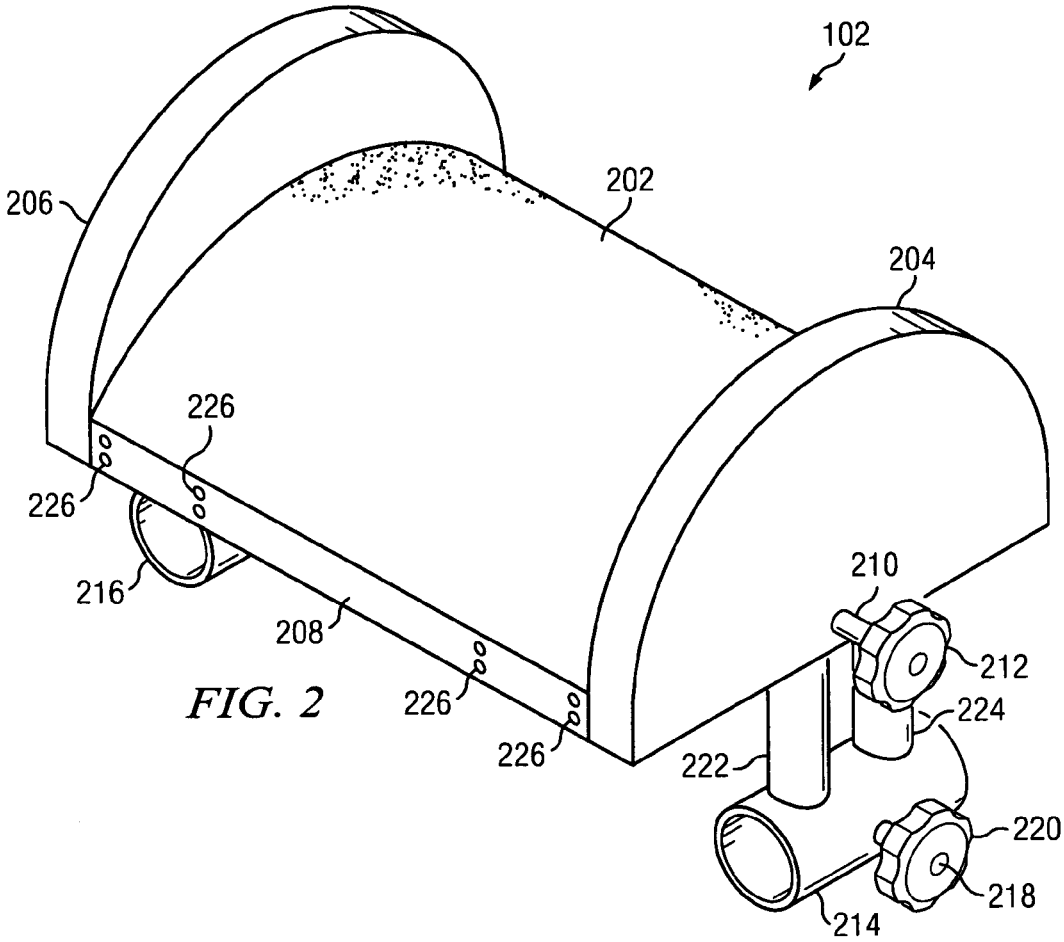
FIG. 2 is an isometric view of a preferred embodiment of the lumbar support of the present invention.
Figure 3:
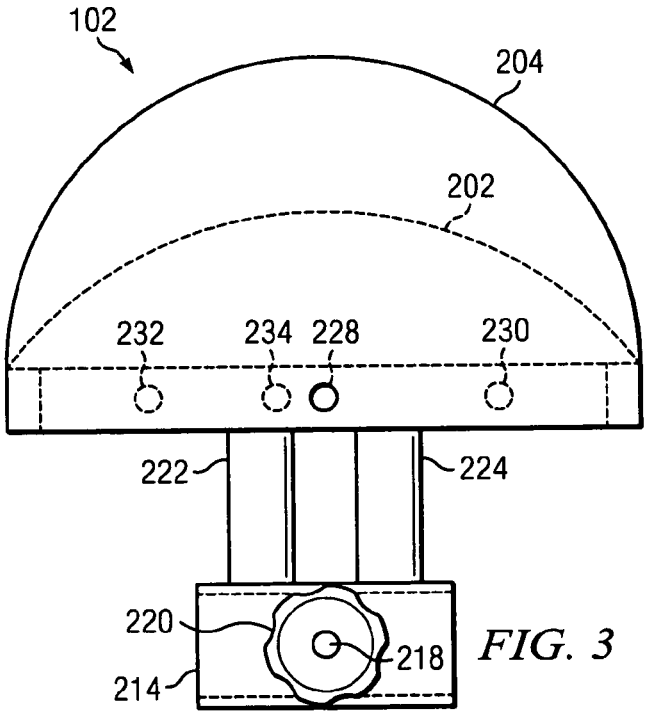
FIG. 3 is a cutaway view of a preferred embodiment of the lumbar support of the present invention.

Referring to FIGS. 2 and 3, spinal flexor 102 includes an arching support surface, two width extending supports, and a frame. Support surface 202 is comprised of an inner shell formed from a semi-rigid material. The shell of support surface 202 is covered by a padding layer and a durable cover layer. The padding layer may be polyethylene closed cell foam or polyurethane open cell foam with an indent load deflection value ranging from 1.8 to 3.5. The durable cover layer may be plastic, vinyl, leather, or some synthetic leather that can withstand frequent use. Support surface 202 has a radius slightly greater than ordinary spinal arching. Ordinary spinal arching for the lumbar section of the spine typically has a radius in the range of 9.4 inches to 9.8 inches. In a preferred embodiment the cylindrical shape of spinal flexor 102 has a radius in the range of 9.5 to eleven inches. Support surface 202 sits on top of and attaches to frame 208. The components of frame 208 to be discussed later are assembled using assembly screws 226 and 227. Guide braces 222 and 224 connect to frame 208 at generally perpendicular angles and extend below frame 208. Adjustment guide 214 connects to both guide braces 222 and 224 at a generally perpendicular angle. Adjustment guide 216 attaches similarly to another pair of guide braces on the opposite side of frame 208. Adjustment guide 214 includes adjustment knob 220 that is affixed to adjustment pin 218. Adjustment pin 218 is threaded and is seated in a threaded hole in the side of adjustment guide 214. Extensions 204 and 206 are generally semicircular shaped members situated on either side of support surface 202. Extensions 204 and 206 are approximately one inch thick and formed of the same material as support surface 202. Extensions 204 and 206 each have a padding layer on the side adjacent to support surface 202 and a durable cover layer all around. Extension 204 includes drive shaft hole 228 through which drive shaft 210 extends. Drive shaft 210 includes drive shaft knob 212 attached to an end.

FIG. 3 is an elevation view of spinal flexor 102 showing the generally semicircular shape of extension 204 and the arc shape of support surface 202. The surface of extension 204 adjacent to support surface 202 includes guide rod hole 230, guide rod hole 232, and extension rod hole 234. Drive shaft hole 228 passes completely through extension 204.

Figure 4:
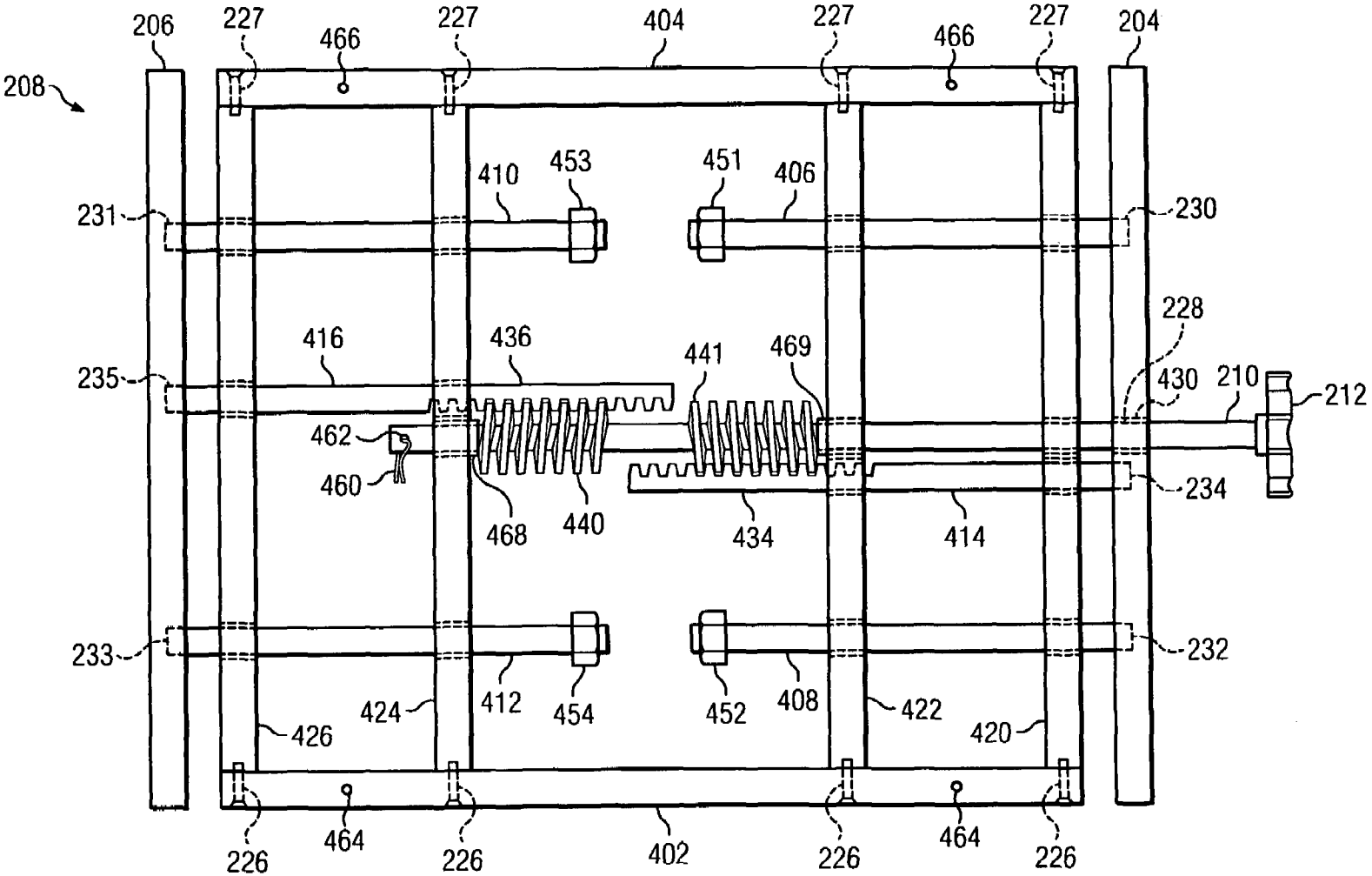
FIG. 4 is a plan view from the underside of a preferred embodiment of the lumbar support of the present invention.

Referring now to FIG. 4, the underside of frame 208 is shown. The main structure of frame 208 is provided by frame ends 402 and 404 and cross braces 420, 422, 424, and 426. In a preferred embodiment, each frame end and cross brace is made of hollow hardened plastic, aluminum or steel ranging in thickness from 1/16 inch to 1/8 inch and a rectangular approximate one inch by one-half inch cross section. Cross braces 420, 422, 424, and 426 are precisely machined parts. The holes bored through each must be concentrically aligned for the guide rods and extension rods to simultaneously slide through each unencumbered. Each hole bored through cross braces 420, 422, 424, and 426 includes a copper or brass bushing to ensure smooth functionality. Frame ends 402 and 404 are connected to the cross braces using assembly screws 226 and 227. An assembled frame 208 is attached to support surface 202 with screws through attachment holes 464 and 466 in frame ends 402 and 404 respectively. In a preferred embodiment, the length of frame ends 402 and 404 (which corresponds to the width of bench 104) ranges from twelve to fourteen inches while the length of cross braces 420, 422, 424, and 426 ranges from nine to eleven inches.

Guide rod 406 fits into guide rod hole 230 of extension 204. Guide rod 408 fits into guide rod hole 232 of extension 204. Extension rod 414 fits into extension rod hole 234 of extension 204. Drive shaft 210 fits through extension 204 via drive shaft hole 228. Drive shaft hole 228 is fitted with bushing 430 to ensure smooth passage. Guide rod 410 fits into guide rod hole 231 of extension 206. Guide rod 412 fits into guide rod hole 233 of extension 206. Extension rod 416 fits into extension rod hole 235 of extension 206. In a preferred embodiment, each guide rod and each extension rod is approximately ½ inch in diameter, threaded on both ends and tightened in a respective threaded hole in the corresponding extension. An additional preferred embodiment may use adhesive to affix each guide rod and each extension rod to the corresponding extensions. In an additional preferred embodiment, each guide rod and extension rod may be ½ inch by ½ inch square rods with rounded and threaded ends. On the exposed threaded tips of guide rods 406, 408, 410, and 412 that are not inserted into extensions 204 and 206 are nuts 451, 452, 453, and 454 respectively. In an additional preferred embodiment, all guide rods may be bolts with a bolt head on one end and threaded on the other for insertion into the extensions.

Drive shaft 210 has a diameter approximately ½ inch except for thread sections 440 and 441. Thread sections 440 and 441 have a diameter approximately equal to one inch and each section is approximately two inches long. Thread sections 440 and 441 are threaded in opposite directions; one being a right-handed thread and the other being the opposite. Thread section 440 begins approximately one inch from the end of drive shaft 210 opposite drive shaft knob 212. Thread section 441 is approximately two inches apart from thread section 440. The end of drive shaft 210 opposite drive shaft knob 212 includes hole 462 through its diameter. Cotter pin 460 fits through hole 462. Washer 468 fits on drive shaft 210 between thread section 440 and cross brace 424. Washer 469 fits on drive shaft 210 between thread section 441 and cross brace 422.

Included in the length of extension rod 414 is rack section 434. Rack section 434 begins on the end of extension rod 414 opposite the end inserted in extension 204. Rack section 434 has a length of approximately four inches. Rack section 434 includes cut grooves designed to mesh with thread section 441 of drive shaft 210. Included in the length of extension rod 416 is rack section 436. Rack section 436 begins on the end of extension rod 416 opposite the end inserted in extension 206. Rack section 436 also has a length of approximately four inches. Rack section 436 includes grooves designed to mesh with thread section 440 of drive shaft 210.

Figure 5:
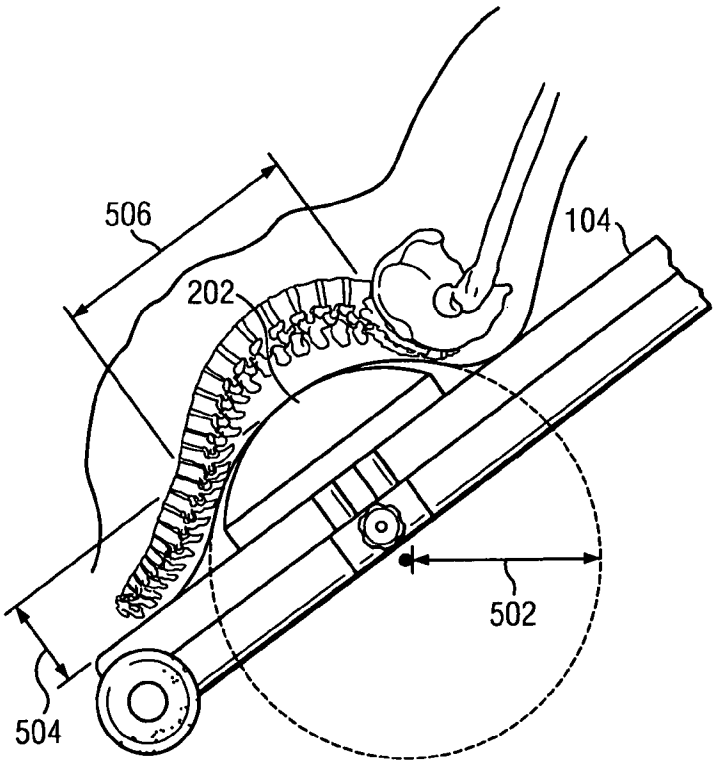
FIG. 5 is an elevation view of a preferred embodiment of the lumbar support attached to the support frame of the present invention.

Referring to FIG. 5, the radius of the arc of support surface 202 is shown as 502. Radius 502 is slightly larger than the normal resting position radius of the curvature of the spinal lumbar section. Peak distance 504 represents the height of support surface 202 from the top surface of bench 104. Spinal flexor length 506 is the length of spinal flexor 102. The measurements of radius 502, peak distance 504, and spinal flexor length 506 maintain a relationship to one another. Each can vary, but once two are fixed, the other can no longer vary. In the preferred embodiment, radius 502 ranges between about 9.5 inches to about eleven inches, peak distance 504 ranges from approximately two to four inches, and spinal flexor length 506 ranges between about ten to about fourteen inches. The lumbar section of an average height adult male or female is properly extended using a radius 502 equal to about ten inches and a spinal flexor length 506 of about twelve inches. In a preferred embodiment, where support surface arc radius 502 is about ten inches and spinal flexor length 506 is about twelve inches, peak distance 504 is calculated to be about three inches.

The Pythagorean theorem is used to calculate the relationship:

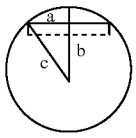

$$c^2 = a^2 + b^2$$

Where 'c' is known as support surface arc radius 502 and in this example is equal to ten inches. Where 'a' is known as half of spinal flexor length 506 and in this example is equal to half of twelve inches or six inches. Where 'b' is calculated to be eight inches which leaves the height of the arc section in the above figure to be (ten minus eight) inches or two inches. Adding in the one inch height of frame 208 (shown as the dashed rectangle above), peak distance 504 is calculated to be three inches total.

Figure 6:
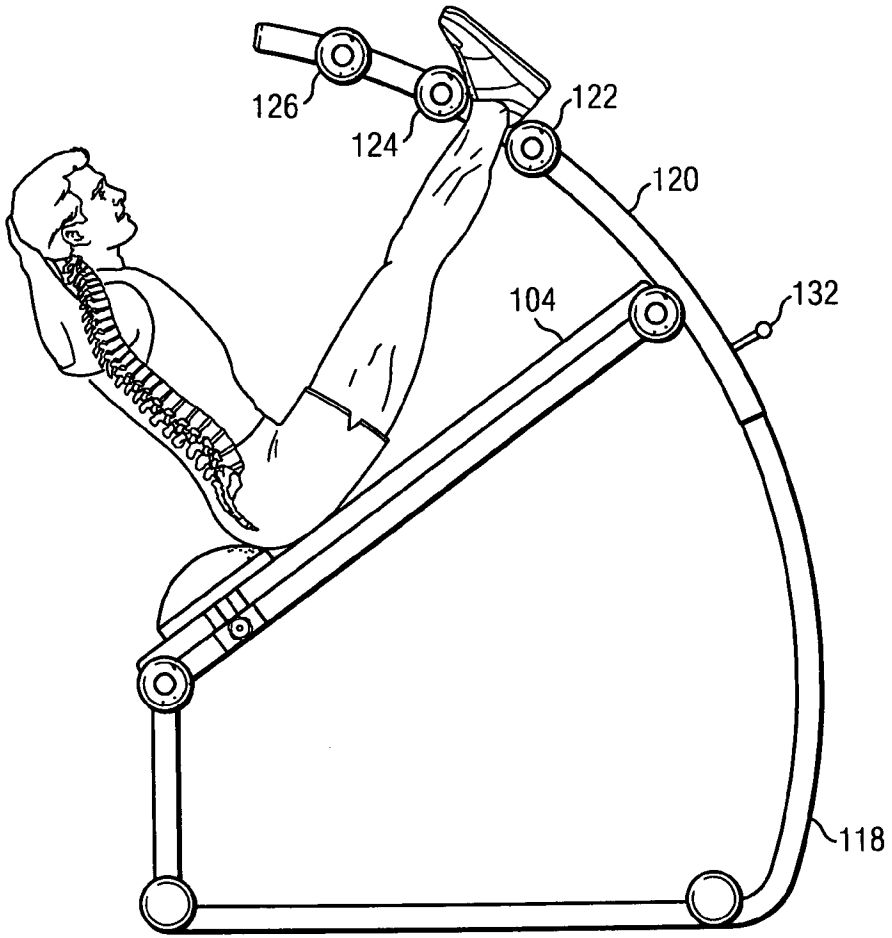
FIG. 6 is an elevation view of a preferred embodiment of the present invention shown at an in incline.

FIGS. 5 and 6 show the starting position (FIG. 5) and the near finishing position (FIG. 6) for a sit-up movement using abdominal exercise apparatus 100. The starting position tightens and stretches all the muscles of the front torso producing a direct connection between the abdominal muscles, the chest muscles, and the neck muscles to pull up the torso as one piece and prevent negative stresses to the spine. The starting position also fully extends and decompresses the lumbar section of the spine before the movement. The lumbar muscles of the back are neutralized. Fully extending the spine at the beginning of the movement not only helps to restore proper intervertebral space, but also prevents the pelvis from abnormally tilting so the torso is free to pivot at the hip joint. The finishing position occurs where the gravitational pull on the torso is neutralized by the torso's generally upright position relative to the floor.

FIGS. 5 and 6 show bench 104 at an incline. A user may perform the movement on bench 104 without an incline or an incline of a different degree. To adjust the inclination, incline pin 132 is disengaged and the arc shaped incline housing 120 is moved through the length of the arc shaped incline support 118. Bench 104 and the attached incline housing 120 rotate about frame end 140. Frame end 140 is seated in hinge 130. Once the desired inclination is reached by raising or lowering bench 104 and incline housing 120, incline pin 132 is reengaged through incline housing 120 and into one of the several bored holes along the length of incline support 118. In a preferred embodiment, incline support 118 includes four holes (not shown) to position bench 104 at four different incline angles of 0°, 15°, 30°, and 45° from the horizontal plane defined by foot 110 and foot 112. Foot rests 122, 124, and 126 are provided to allow the user to elevate the position of their feet even further. As the height of a user's feet increases, either through inclination of bench 104, the use of the foot rests, or a combination of both, the distance the torso moves and subsequently the difficulty of the movement increases.

Figure 7:
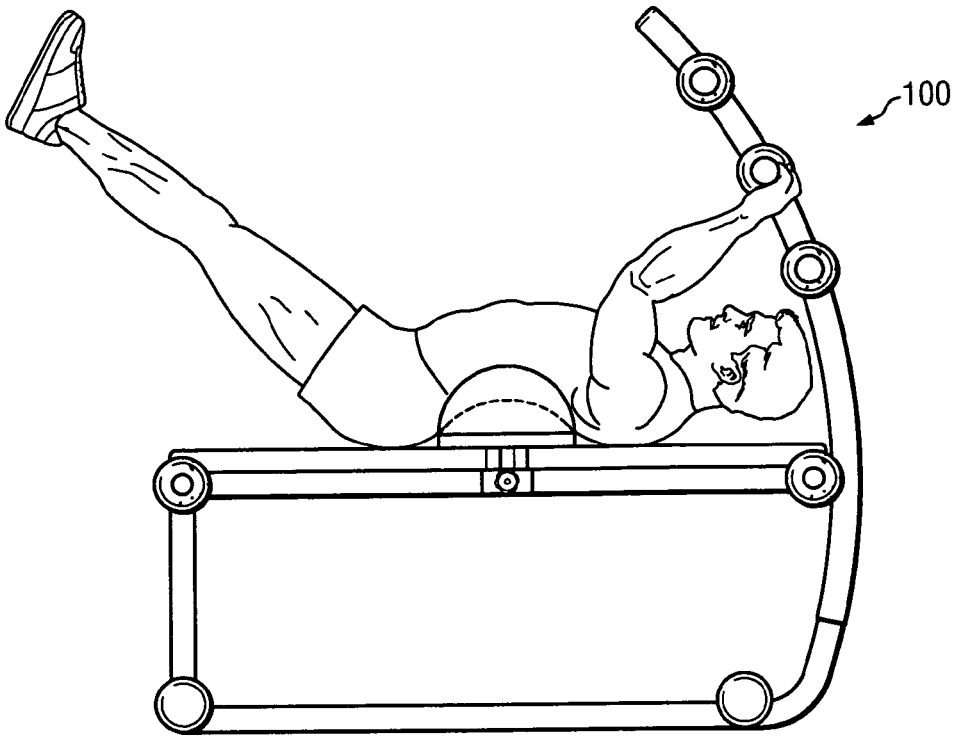
FIG. 7 is an elevation view of a preferred embodiment of the present invention showing the legs-up movement.
Figure 9:
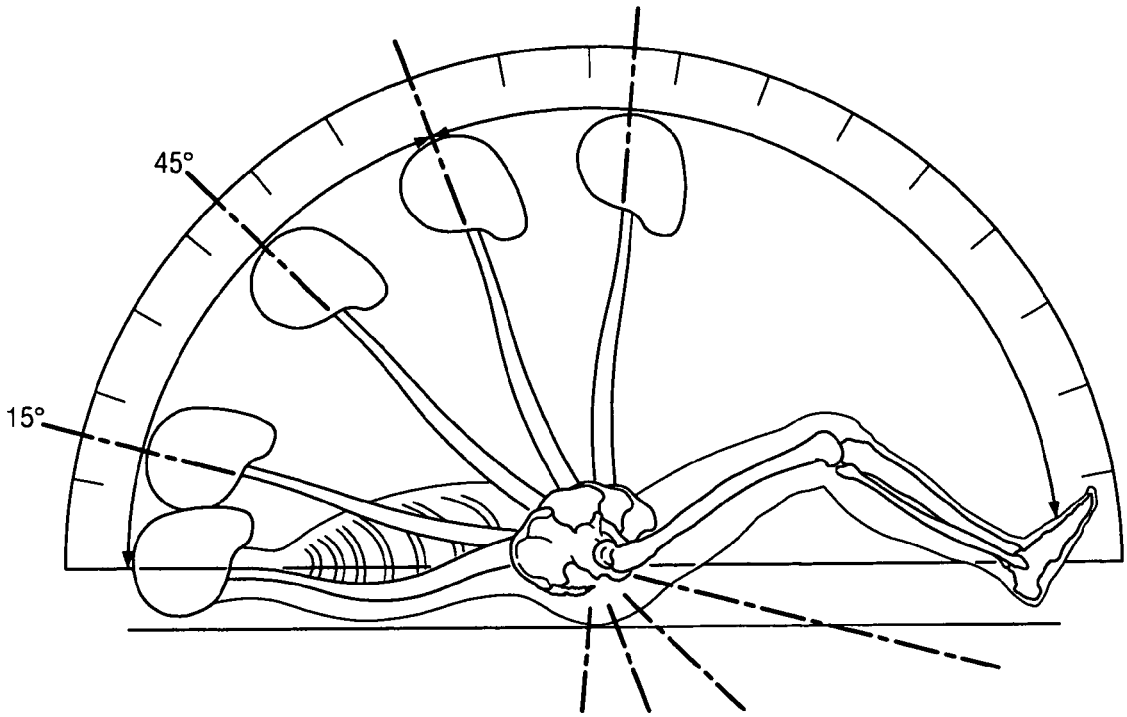
FIG. 9 is an illustration of the spinal position during a sit-up movement performed on a flat surface.

The position of spinal flexor 102 may be adjusted along the length of bench 104. Spinal flexor 102 may be moved further from incline housing 120 to adjust for larger legs. Spinal flexor 102 may be closer to incline housing 120 as shown in FIG. 7 for a legs-up movement. Spinal flexor 102 is held in place by rotating adjustment pin knob 220 until adjustment pin 218 comes in contact with frame rail 106 and then tightening the knob until friction between the pin and the rail hold a fixed position. Adjusting the longitudinal position of spinal flexor 102 begins by rotating adjustment pin knob 220 in a counter-clockwise direction disengaging adjustment pin 218 from direct contact with frame rail 106. Sliding spinal flexor 102 along frame rails 106 and 108 to the desired location and re-tightening adjustment pin 218 until it securely contacts frame rail 106 completes the longitudinal adjustment.

The width of spinal flexor 102 may be adjusted to accommodate different sized torsos. Extensions 204 and 206 each may be adjusted approximately two inches from their starting positions. Rotating driveshaft 210 via driveshaft knob 212 simultaneously moves both extensions 204 and 206 inward or outward depending on the direction of rotation. Nuts 451, 452, 453, and 454 secured to the ends of guide rods 406, 408, 410, and 412 respectively restrict the amount of width adjustment and prevent extensions 204 and 206 from becoming disengaged from frame 208. The threads of thread sections 440 and 441 on driveshaft 210 engage rack section 436 of extension rod 416 and rack section 434 of extension rod 414 simultaneously. The wider diameters of thread sections 440 and 441 in conjunction with washers 468 and 469 and cotter pin 460 hold driveshaft 210 in place in frame 208. As driveshaft 210 rotates, its lateral position relative to frame 208 does not change. As driveshaft 210 rotates, thread sections 440 and 441 engage the grooves of rack sections 436 and 434 respectively and forcibly slide extension rods 414 and 416 inward or outward at the same rate effectively increasing or decreasing the width of spinal flexor 102 by virtue of extension rods 414 and 416 being connected to extensions 204 and 206 respectively.

In use, the user first sets the angle of inclination of bench 104. A more dramatic incline increases the difficulty of the movement. Next the user adjusts the longitudinal position of spinal flexor 102. The correct longitudinal position along bench 104 situates the pelvis of the user in the crease created between spinal flexor 102 and bench 104 while allowing the legs of the user to be comfortably bent. Next the user adjusts the width of spinal flexor 102 to accommodate a particular body size. With the feet supported by a foot rest or positioned flatly on bench 104, the user lays back over spinal flexor 102 in the supine position. Spinal flexor 102 supports the lumbar section of the user's spine, prevents the pelvis from abnormally tilting, and creates a pivot point at the pelvis of the user. The starting position stretches all the front muscles of the torso including the abdominals and the chest and neck muscles in preparation for the movement. In addition to neutralizing the lumbar muscles of the back, the starting position also fully extends and decompresses the lumbar section of the spine. With spinal flexor 102 acting as a fulcrum, the torso pivots at the pelvis as the front muscles of the torso contract safeguarding the natural curvature of the spine and preventing negative stresses on the spine.

Referring to FIG. 7, a user is shown performing a legs-up movement on abdominal exercise apparatus 100. Extensions 204 and 206 are not pictured to demonstrate the user's position relative to spinal flexor 102. During this movement, the spine remains relatively stationary. The muscles of the thigh initiate the movement and pass it subsequently to the abdominal muscles until the legs reach a completely vertical position. Spinal flexor 102 again fully extends the lumbar section of the spine, stretches the front muscles of the torso, neutralizes the lumbar muscles, and acts as a fulcrum for the legs to pivot at the user's pelvis.

Figure 8:
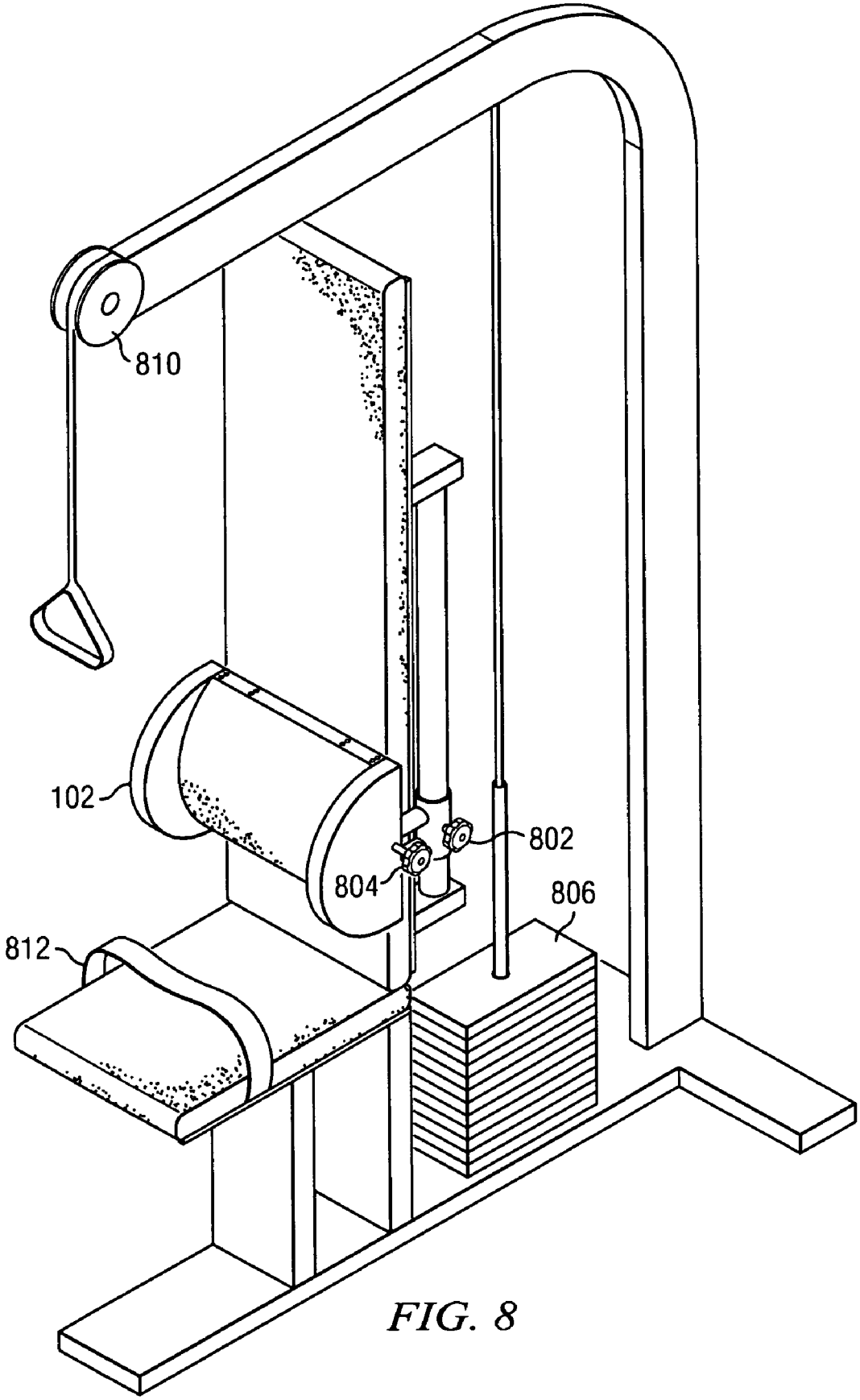
FIG. 8 is an isometric view of a preferred embodiment of the lumbar support attached to a fitness machine

FIG. 8 shows a vertical application of spinal flexor 102 complete with vertical adjustment 802 and lateral adjustment 804. A user moves an adjustable stack of weights 806 by virtue of a pulley system 810. In use, spinal flexor 102 stretches the front muscles of the torso and fully extends the lumbar section of the spine before the movement begins. The vertical application prevents negative stresses on the spine by supporting the spine prior to the movement and stabilizing the spine during the movement. Additionally, a belt 812 or tie-down may be utilized by the user to keep the body secure to spinal flexor 102 thereby ensuring spinal flexor 102 supports the spine and is used as a fulcrum for the pelvis to pivot about.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. An abdominal exerciser apparatus comprising:

a support frame;

a bench track pivotally affixed to the support frame;

a bench surface region affixed to the bench track;

an extension support rigidly affixed to the support frame;

an extension, having a predefined first radial arc, rigidly affixed to the bench track including a plurality of perpendicular footrests telescopically supported by the extension support;

a first locking pin between the extension and the extension support;

a lumbar support adjacent the bench surface and slidingly supported by the support frame;

a second locking pin between the lumbar support and the support frame;

the lumbar support having a semicylindrical support surface with a second predefined radial arc;

a laterally adjustable first wall connected to the lumbar support;

a laterally adjustable second wall connected to the lumbar support; and, an adjustment means, attached to each of the pair of walls, for laterally moving the pair of walls with respect to the semicylindrical support surface.

2. The apparatus of claim 1, wherein the first radial arc has a radius approximately equal to the length of the bench surface.

3. The apparatus of claim 1, where the extension is adjustable with respect to the extension support wherein the bench surface is adjusted to one of the group of 0°, 15°, 30°, or 45° with respect to the support frame.

4. The apparatus of claim 1, where the plurality of footrests comprises four footrests equally spaced on the extension.

5. The apparatus of claim 1, where the second predefined radial arc is between about 9.5 and about eleven inches.

6. The apparatus of claim 1 wherein the adjustment means comprises:

a first drive rod attached to the first wall;

a second drive rod attached to the second wall;

the first drive rod having a first drive rack;

the second drive rod having a second drive rack;

a drive shaft adjacent the first drive rod and the second drive rod;

the drive shaft having a clockwise drive section and a counterclockwise drive section;

the counterclockwise drive section engaged with the first drive rack and the counterclockwise drive section engaged with the second drive rack;

a bearing movement frame;

a first latitudinal glide means connected between the first wall and the bearing mount frame for directing transactional movement of the first wall with respect to the bearing movement frame; and, a second latitudinal glide means connected between the second wall and the bearing movement frame for directing transactional movement of the second wall with respect to the bearing movement frame.

7. An exercising apparatus comprising:

a frame;

a bench rotatably attached to the frame;

an arc shaped projection attached to the bench, having a radius approximately equal to the length of the bench, containing a plurality of footholds and a pin;

a lumbar support, having an arc shaped back support surface with a radius between about 9.5 inches and about eleven inches, adjacent the bench;

a projection receiver, having a plurality of equidistant pin holes, rigidly attached to the frame;

a pair of laterally adjustable generally semicircular shaped members attached to the lumbar support surface;

wherein the lumbar support is longitudinally slidable along the length of the bench; and, wherein the bench is rotatable to an angle of one of the group of 0°, 15°, 30°, or 45° with respect to the frame.

8. The apparatus of claim 7 where the plurality of footholds are padded.

9. The apparatus of claim 7 where the plurality of footholds are equidistant from each other.

10. A method of exercising the abdominal muscles of the body comprising:

providing a bench rotatably attached to a frame;

providing an arc shaped extension including a plurality of cross members and an inclination pin attached to the frame;

providing an arc shaped extension support including a plurality of holes attached to the bench;

providing an arc shaped lumbar support adjacent the bench creating a seam at the and adjustably attached to the frame with an adjustment pin;

providing a shaft with a knob and two oppositely threaded sections adjacent to a pair of notched rods where each rod is attached to one of a pair of semicircular shaped sideboards located on opposing lateral sides of the lumbar support;

adjusting the inclination of the bench;

adjusting the longitudinal position of the lumbar support on the bench;

adjusting the width of the lumbar support;

positioning the body lengthwise on the bench;

supporting the body with the arc shaped lumbar support; and, raising the torso of the body using only the abdominal muscles of the body.

11. The method of claim 10 further comprising:

supporting the feet of the body with one of the plurality of cross members.

12. A method of exercising the abdominal muscles of the body comprising:

providing a bench rotatably attached to a frame;

providing an arc shaped extension including a plurality of cross members and an inclination pin attached to the frame;

providing an arc shaped extension support including a plurality of holes attached to the bench;

providing an arc shaped lumbar support adjacent the bench creating a seam at the and adjustably attached to the frame with an adjustment pin;

providing a shaft with a knob and two oppositely threaded sections adjacent to a pair of notched rods where each rod is attached to one of a pair of semicircular shaped sideboards located on opposing lateral sides of the lumbar support;

adjusting the inclination of the bench;

adjusting the longitudinal position of the lumbar support on the bench;

adjusting the width of the lumbar support;

positioning the body lengthwise on the bench;

supporting the body with the arc shaped lumbar support; and, raising the legs of the body using only the abdominal muscles of the body.

13. The method of claim 12 further comprising:

bracing the arms of the body with one of the plurality of cross members.

* * * * *